US005131315A

United States Patent [19]

Maher et al.

[11] Patent Number: 5,131,315

[45] Date of Patent: Jul. 21, 1992

[54] MAGAZINE CONVEYOR FOR LARGE CALIBER AMMUNITION

[75] Inventors: David L. Maher, Hero; David N. Watt, So. Burlington; Callista M. Young, Milton, all of Vt.

[73] Assignee: General Electric Company, Burlington, Vt.

[21] Appl. No.: 633,553

[22] Filed: Dec. 24, 1990

[51] Int. Cl.[5] ..... F41A 9/04

[52] U.S. Cl. ..... 89/45; 89/33.1; 89/34

[58] Field of Search ..... 89/45, 46, 33.02, 33.14, 89/33.16, 34, 33.01, 36.09, 33.1, 35.01

[56] References Cited

U.S. PATENT DOCUMENTS

| | | | |
|---|---|---|---|
| H592 | 3/1989 | Gillum | 89/46 |
| 2,437,425 | 3/1948 | Goodhue et al. | 89/34 |
| 2,501,143 | 3/1950 | Sanford | 89/33.25 |
| 3,045,553 | 7/1962 | Mosle | 89/33.16 |
| 3,362,293 | 1/1968 | Jafvert | 89/33.01 |
| 3,367,236 | 2/1968 | Menneking | 89/33.04 |
| 3,489,059 | 1/1970 | Berek | 89/1.801 |
| 3,501,996 | 3/1970 | Lipp et al. | 89/46 |
| 3,875,845 | 4/1975 | Hupp et al. | 89/33.04 |
| 4,252,049 | 2/1981 | Franz et al. | 89/34 |
| 4,263,837 | 4/1981 | Tassie | 89/34 |
| 4,619,181 | 10/1986 | Pehker et al. | 89/34 |
| 4,656,922 | 4/1987 | Bohler et al. | 89/33.17 |
| 4,681,018 | 7/1987 | Beckmann | 89/33.04 |
| 4,681,019 | 7/1987 | Brandl et al. | 89/33.14 |
| 4,735,126 | 4/1988 | Koine | 89/33.04 |
| 4,841,837 | 6/1989 | Novet | 89/33.25 |
| 4,860,633 | 8/1989 | Wiethoff et al. | 89/45 |
| 4,878,416 | 11/1989 | Orquera et al. | 89/1.81 |
| 4,885,976 | 12/1989 | Nordmann | 89/35.01 |

FOREIGN PATENT DOCUMENTS

| | | | |
|---|---|---|---|
| 3421167 | 12/1985 | Fed. Rep. of Germany | 89/33.02 |
| 670698 | 6/1989 | Switzerland | 89/35.01 |

*Primary Examiner*—Stephen M. Johnson
*Attorney, Agent, or Firm*—Stephen A. Young

[57] ABSTRACT

A conveyor for large caliber ammunition includes upper and lower chains mounted within a magazine to run in a compact serpentine path. The lower chain includes platform links on which ammunition rounds (projectiles and propellant canisters) rest in upright orientations. Resiliently backed ball casters, affixed to the upper and lower chains, run in magazine guide tracks and roll on the track bottom surface to provide smooth and efficient conveyor operation. Retainers cradle the ammunition rounds to maintain their upright stand on the conveyor and to ensure that they are safely propelled through the turns in the serpentine conveyor path.

21 Claims, 4 Drawing Sheets

MAGAZINE CONVEYOR FOR LARGE CALIBER AMMUNITION

The present invention relates to ammunition magazines and particularly to magazine conveyors for storing and handling large caliber ammunition.

BACKGROUND OF THE INVENTION

Heretofore, the task of handling ammunition for large caliber artillery pieces, such as howitzers, has been highly labor intensive and time consuming. To reduce the number of military personnel required and to save time, both in terms of resupplying and loading artillery pieces, automated ammunition handling equipment has been proposed. The design of such equipment is complicated by the fact that it must accommodate various types of projectiles and/or propellant canisters as separate units. The equipment, as implemented in an ammunition container or magazine, must safely store the ammunition, i.e., projectiles and propellant canisters, during transport over rough terrain in a resupply vehicle and by the artillery piece, if it is of the mobile or self-propelled type. Since space is always at a premium, the magazine should accommodate as high an ammunition packing or storage density as possible. And, when called upon, the magazine must be capable of reliably conveying ammunition at a high feed rate with an efficient use of power.

SUMMARY OF THE INVENTION

It is accordingly an object of the present invention to provide a magazine having an improved conveyor for storing and conveying large caliber ammunition.

A further object is to provide a magazine conveyor of the above-character, which is capable of high storage densities.

Another object is to provide a magazine conveyor of the above-character, wherein the ammunition is stored under positive control to withstand vibration and shock loads during transport.

An additional object is to provide a magazine conveyor of the above-character, wherein the ammunition is maintained under positive control during conveyance within the magazine.

Yet another object is to provide a magazine conveyor of the above-character, wherein ammunition conveyance is achieved smoothly and reliably with efficient utilization of power.

Other objects of the invention will in part be obvious and in part appear hereinafter.

In accordance with the present invention, there is provided an improved magazine conveyor for holding large caliber ammunition in storage and for feeding ammunition into and out of a storage. The conveyor includes upper and lower endless chains trained in vertically aligned relation along serpentine paths by upper and lower guide tracks. The lower chain includes ammunition load-bearing links alternating with and pivotally interconnected by connector links. Each load-bearing link includes a pair of platforms on which adjacent ammunition rounds (projectile or propellant canister) rest, with each platform receiving underlying support from a resiliently backed ball caster rolling on the magazine floor. The upper chain includes a series of pivotally interconnected links which may also be equipped with resiliently backed casters rolling on a magazine top plate.

The links of the upper and lower chains are interconnected by a series of rungs uniformly distributed along the conveyor length. Each rung carries a plurality of vertically spaced retainers which are equipped with cradle elements configured to conform with and wrap partially around the peripheries of the ammunition units to maintain their vertical orientation during magazine transport and ammunition conveyance within the magazine. The conveyor is driven by sprockets engaging the upper and lower chains and located inwardly of the turns in the serpentine path to conserve space.

The invention accordingly comprises the features of construction, combination of elements, and arrangement of parts, all as described below, and the scope of the invention will be indicated in the appended claims.

BRIEF DESCRIPTION OF THE DRAWINGS

For a full understanding of the nature and objects of the invention, reference may be had to the following Detailed Description taken in conjunction with the drawings, in which.

Corresponding reference numerals refer to like parts throughout the sectional views of the drawings.

DETAILED DESCRIPTION

Figure 1:
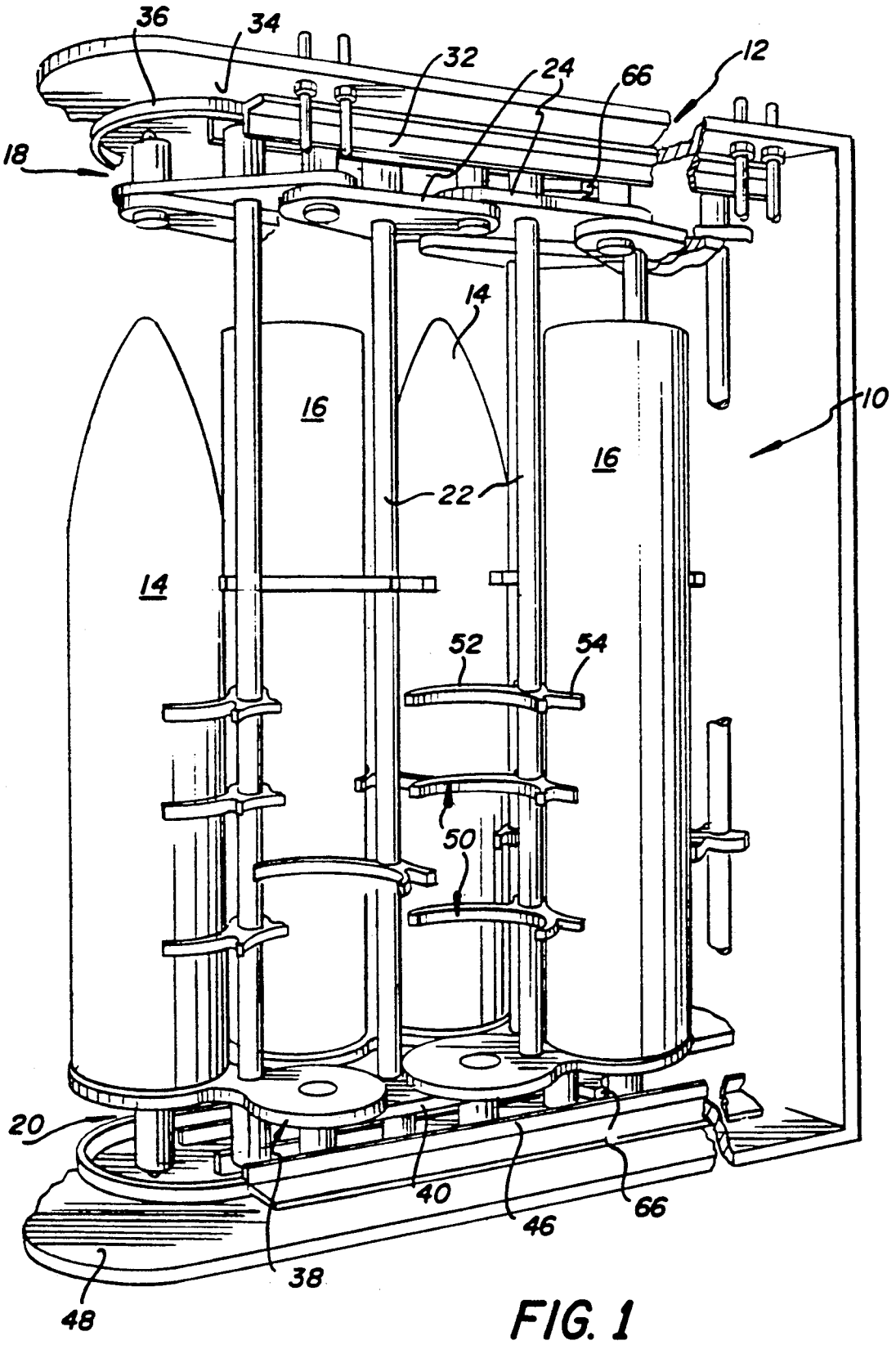
FIG. 1 is fragmentary perspective view of a magazine ammunition conveyor constructed in accordance with the present invention.
Figure 2:
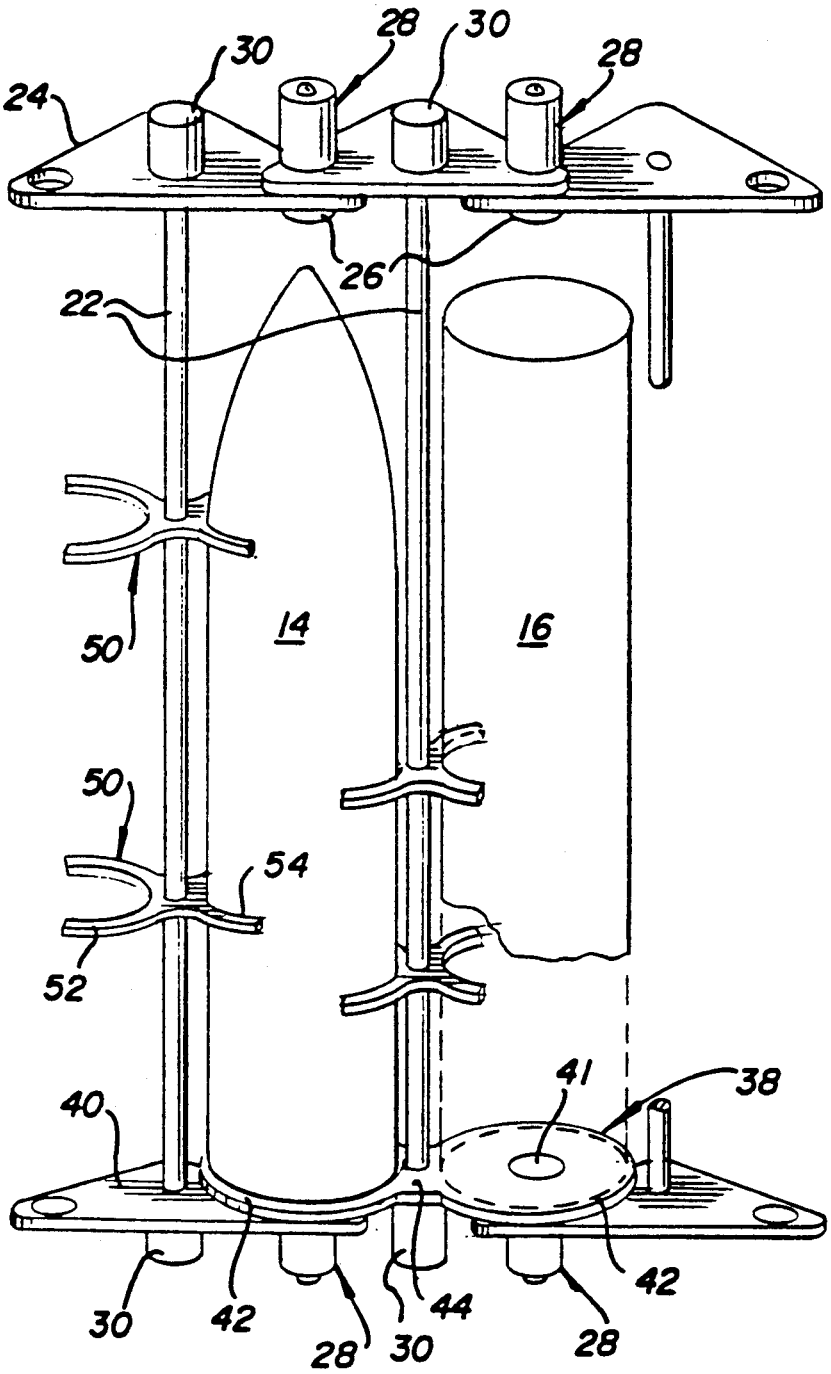
FIG. 2 is a perspective view of a portion of the FIG. 1 shown apart from the magazine.

The ammunition conveyor of the present invention, generally indicated at 10 in FIGS. 1 and 2, handles large caliber artillery ammunition while in storage within a magazine, generally indicated at 12, and during conveyance into and out of storage. In the illustrated embodiment, conveyor 10 handles projectiles 14 and propellant canisters 16 in alternating carrier positions, however, it will be appreciated that the conveyor may handle solely projectiles or solely propellant canisters. Moreover, the conveyor may handle large caliber, cartridged ammunition, wherein the projectile and propellant are combined as a single unit. The conveyor includes an upper, endless chain, generally indicated at 18, and a lower chain, generally indicated at 20, which are interconnected at regularly spaced intervals by a series of rungs 22. The spaces between rungs define carrier positions for the ammunition rounds, either projectiles or propellant canisters.

The upper chain consists of a series of triangular-shaped links 24 pivotally interconnected by headed pins 26. Affixed to each of the links in vertical alignment with each pin is a ball caster, generally indicated at 28 and described below in conjunction with FIG. 4. It will be appreciated that pins 26 and ball casters 28 may be constructed as integral units. Also affixed, such as by weldments, to each link 24 at a position aligned with and mid-way between ball casters is an upstanding post 30. The upper ends of rungs 30 are welded to the links at locations somewhat laterally offset from the aligned ball casters 28 and posts 30. As seen in FIG. 1, casters 28 and posts 30 run in tracks 32 affixed to an upper plate 34 of magazine 12 so as guide upper chain movement through the straight runs of a serpentine conveyor path. Outboard guides 36 may be provided to guide the upper chain ball casters and posts through the 180° turnarounds.

Still referring to FIGS. 1 and 2, lower chain 20 consists of load bearing links, generally indicated at 38, alternating with connector links 40 of the same triangular shape as upper chain links 24. These links are pivotally interconnected by pins, one seen at 41 in FIG. 2. Load bearing links 38 are of a bowtie-like shape having a pair of platforms 42 interconnected by a web 44. When conveyor 10 is to handle projectiles 14 and propellant canisters 16 in alternating fashion, one platform 42 of each link serves as a rest for a projectile in vertical orientation, while the other platform is a rest for a vertically oriented propellant canister. Centrally located with respect to each platform is a depending ball caster 28 of the construction described below. As in the case of upper chain 18, posts 30 are affixed in depending relation to links 38 and 40 at locations aligned with and mid-way between the ball casters. These posts and ball casters run in tracks 46 vertically aligned with upper tracks 32 and affixed to a bottom plate 48 (FIG. 1) of magazine 12. These lower tracks guide lower chain 20 through the straight runs of the conveyor serpentine path. The lower ends of rungs 22 are welded to links 38 and 40 at locations laterally offset from the aligned series of ball casters 28 and posts 30.

Figure 3:
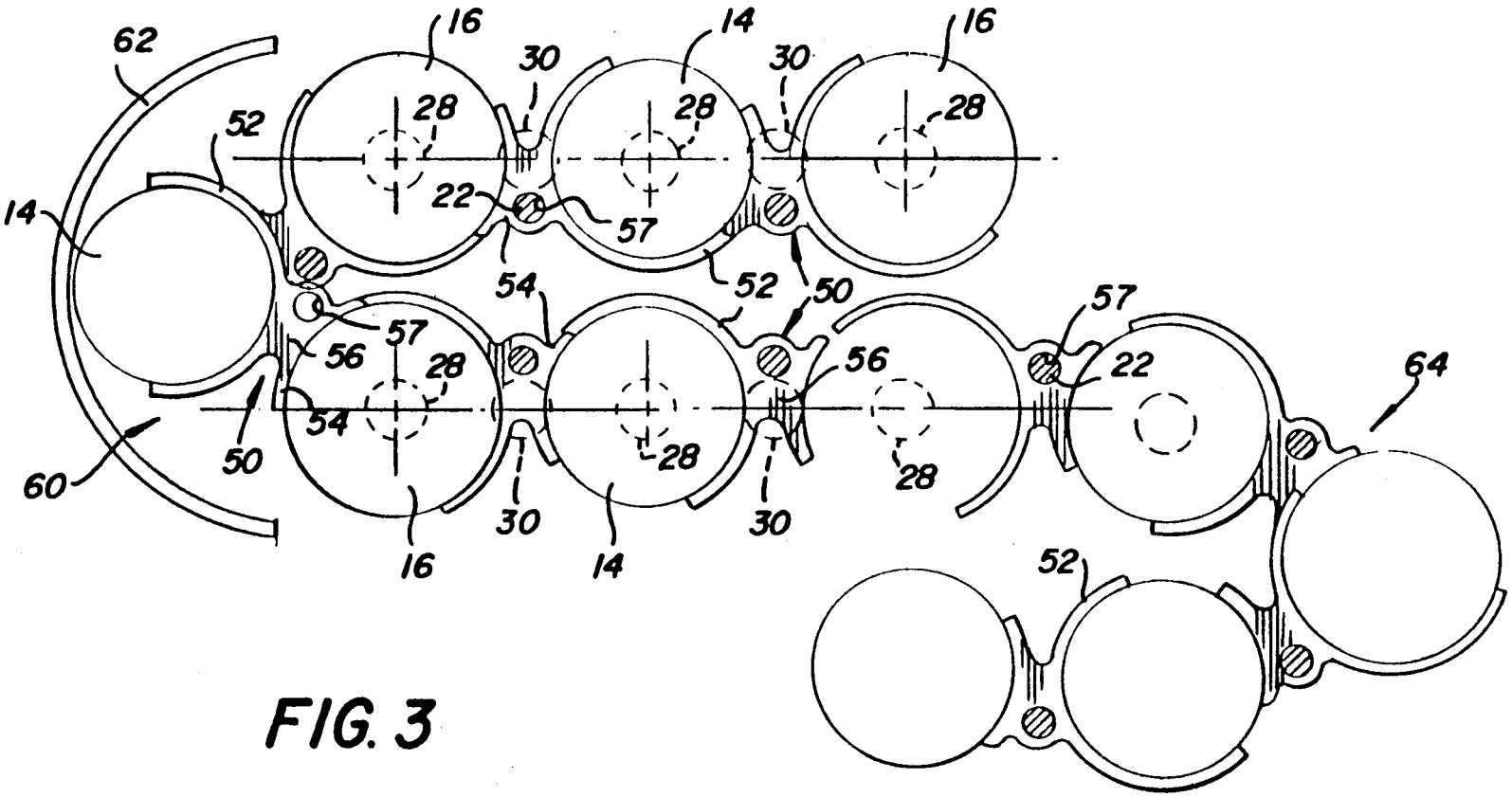
FIG. 3 is a plan view of portions of the serpentine conveyance path of the conveyor of FIG. 1.

To maintain the vertical orientations of the projectiles and propellant canisters during storage on and conveyance by conveyor 10, each rung 22 is equipped with several vertically spaced retainers, generally indicated at 50. Each retainer includes a pair of oppositely faced cradle elements 52 and 54 interconnected by a web 56 which is apertured at 57 (FIG. 3) for receipt of and attachment to a rung by suitable means, such as welding. As best seen in FIG. 3, cradle elements 52 are configured to conform to and wrap around the periphery of a projectile 14 or propellant canister 16 over an included or cradling angle of at least 180°. Cradle elements 54 are smaller in that they are configured to conform to and wrap around the periphery of a projectile or propellant canister over a cradling angle of less than 90°, but greater than 60°. If the projectiles and propellant canisters differ slightly in diameters, the cradle elements are dimensioned accordingly, as illustrated in FIG. 3.

The portion of the serpentine conveyor path seen in FIG. 3 illustrates how of retainers 50 of adjacent rungs 22 cooperate to maintain the projectiles and propellant canisters in their carrier positions supported on the link platforms 42. That is, the large cradle elements 52 of those retainers carried by one rung are generally in opposed relation to the small cradle elements 54 of those retainers carried by an adjacent rung while the projectiles and propellant canisters are occupied in straight runs of the conveyor serpentine path. Thus they are cradled over a cumulative, included angle well in excess of 180°, actually the sum of the cradling angles of the large and small cradle elements. The only instances when this is not the case are when the projectiles and propellant canisters occupy or are being conveyed through 180° turnarounds in the direction of the one illustrated at 60 in FIG. 3. Here it is seen that the cradle elements 52 and 54 slide about the periphery of a projectile or propellant canister in the turnaround such as to assume vertically lapping relations. Consequently, the projectile or propellant canister is controlled solely by cradle elements 52 while in turnarounds 60. Thus, guides 62 are installed in these turnarounds to cooperate with cradle elements 52 in maintaining positive control of the ammunition. Since only the large cradle elements are cradling the ammunition in turnarounds 60, one of these trunarounds in the serpentine conveyor path is advantageously utilized as a transfer station where ammunition round handoffs are performed to load and unload the conveyor. To avoid interference as the cradle elements 52 and 54 lap one another, the retainers 50 are affixed to the rungs in vertically staggered positions, as seen in FIG. 2.

It will be further noted in FIG. 3 that 180° turnarounds in the opposite direction, such as turnaround 64, only achieve a partial vertical lapping of the large and small cradle elements. Thus ammunition in turnarounds 64 are cradled over a cumulative cradling angles sufficiently in excess of 180° to maintain positive control of the projectiles and propellant canisters occupying and transiting turnarounds 64. Consequently there is no need for turnaround guides. This difference in retainer cradling in turnarounds 60 and 64 is produced by the lateral offsets of the rung connections to the upper and lower chain links and the retainer connections to the rungs relative to the in-line, track-guided ball casters 28 and posts 30, plus the cocked relation of the cradle elements 52 and 54 of each retainer.

To make efficient use of magazine storage space, turnaround sprockets are eliminated and conveyor driving sprockets are stationed inboard of the 180° turnarounds in the serpentine conveyor path in the manner taught in commonly assigned U.S. Pat. No. 4,263,837, issued Apr. 28, 1981 to Douglas P. Tassie. The disclosure of this patent is specifically incorporated herein by reference. Thus, as seen in FIG. 1, commonly driven sprockets 66 are positioned inwardly of turnaround 60 and in driving engagements with the ball casters 28 and posts 30 of the upper and lower chains to propel the conveyor along its serpentine path.

Figure 4:
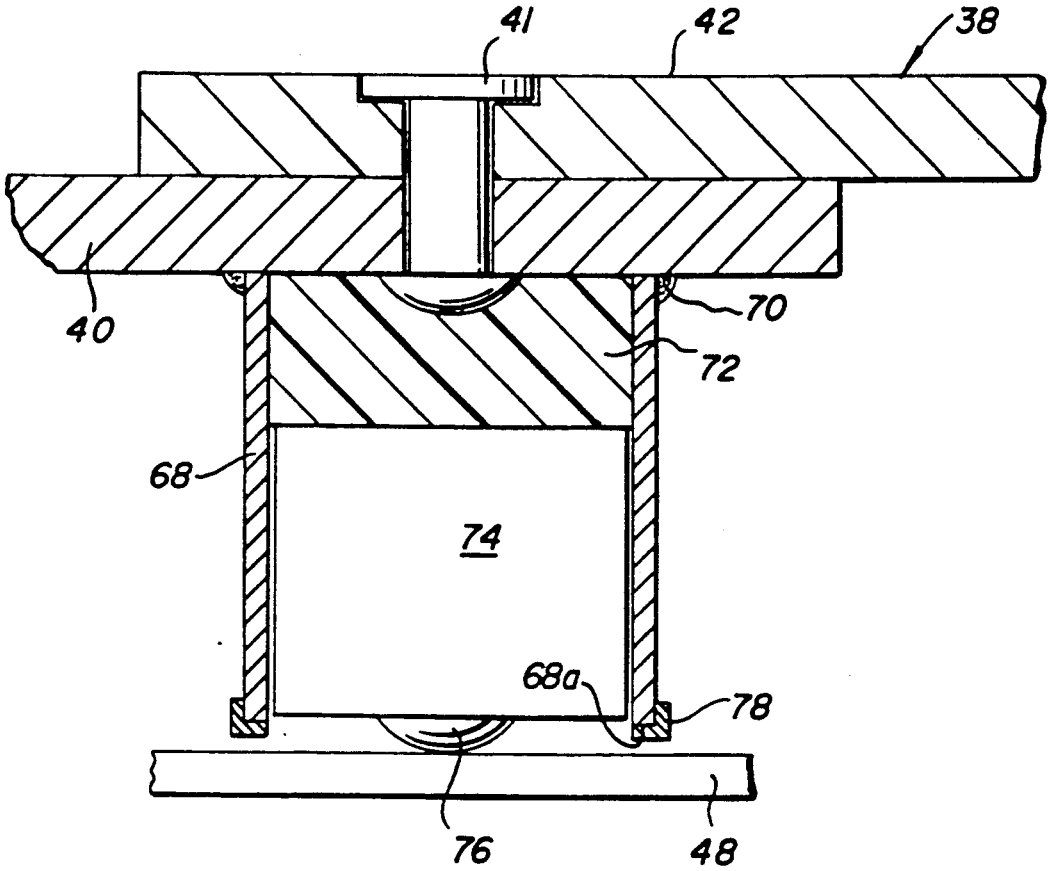
FIG. 4 is a sectional view of one of the ball casters utilized in the suspension mounting of the conveyor of FIG. 1.

As seen in FIG. 4, ball casters 28 include a mounting sleeve 68 which is affixed, such as by a weldments 70, to connector link 40, in the case of lower chain 20. Disposed in the closed upper end of sleeve 68 is a block 72 of resilient material, such as an elastomer. A ball caster unit 74 containing a freely rotating ball 76 is slidingly received in the open lower end of the sleeve, with the ball protruding therebeyond for rolling engagement with plate 48 serving as the bottom surface of lower guide track 46. Affixed to the lower rim **68*a* of the sleeve is a hard stop buffer ring 78** of a suitable material, such as hard plastic.

Upon assembly of conveyor 10 in magazine 12, the vertical spacing between top plate 34 and bottom plate 48 is such that resilient blocks 72 are somewhat compressed to preload the conveyor mounting and thus eliminate vertical end play. Subsequent shock loading of the conveyor and its ammunition cargo is effectively absorbed by the cushioned backing provided by the resilient blocks 72. The buffer rings serve to minimize contact stress between the caster balls 76 and the guide tracks bottom surfaces (plates 34 and 48) under conditions of high acceleration during conveyor starts and stops. The resilient blocks then compress to the extent that the buffer rings 78 contact the track bottom surfaces. Since the buffer rings afford more contact surface area than the caster balls, contact stresses are significantly reduced. Posts 30 on the upper and lower chains are shorter than the ball casters 28 so as to remain in non-contacting relation with the top and bottom plates.

It will be appreciated that the utilization of ball casters in the conveyor suspension mounting affords smooth, non-binding movement throughout the straightaways and arious 90° and 180° turns in the serpentine path, as the caster balls 76 roll freely in any direction.

Figure 5:
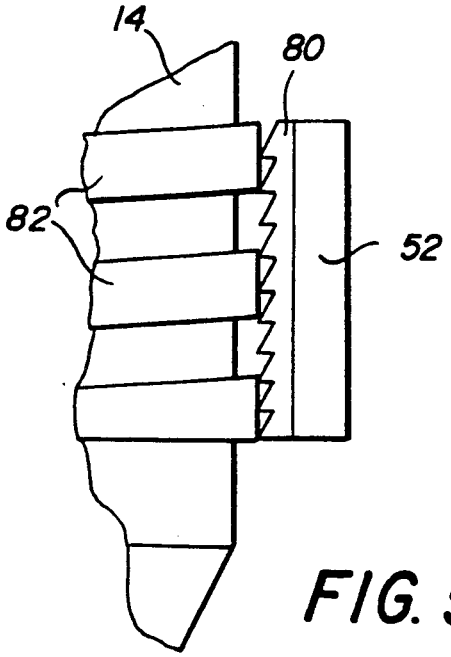
FIG. 5 is fragmentary view, partially in section, illustrating a feature of the control exerted on projectiles carried by the conveyor of FIG. 1.

As an additional feature of the invention, the large cradle elements 52 are lined with an elastomeric gripper material 80, as seen in FIG. 5, to frictionally engage the peripheries of the projectiles and thus provide a measure of vertical restraint thereon. When the large cradling elements are vertically positioned to cradle and engage the rotating bands 82 of the projectiles, a substantial positive restraining force is available to maintain these cradling elements in full control of the projectiles under shock loading and while transiting the 180° turnarounds. This is particularly important with regard to turnarounds 60 to avoid rubbing contact with turnaround guides 62.

As noted above, the large cradle elements 52 are configured to provide at least a 180° cradling angle. To provide more positive control of projectiles and propellant canisters, particularly while in turnaround 60, the cradling angle may be increased to approximately 200°. In this case, the cradling elements are structured to be somewhat resilient such that the free ends yield to accommodate loading of a projectile or propellant into a carrier position. The ammunition is thus held in "snap-fit" fashion with the free ends of the cradle elements 52 exerting inwardly directed retention forces to positively control the projectiles and propellant canisters in their upright orientations resting on platforms 42. During conveyance, the retainers exert the major driving forces on the ammunition, and thus the increased cradling angle of cradle elements 52 provides excellent driving angles to constrain the rounds in their carrier positions while transiting the turnarounds. During reloading, the cradle elements 52 flex to permit the projectiles and propellant canister to be handed off from the conveyor at a turnaround 60.

From the foregoing Detailed Description, it is seen that the ammunition conveyor of the present invention provide for safe storage of projectiles and propellant canisters within a magazine. Positive control over the ammunition is maintained so as to withstand vibration and shock loading occurring during magazine transport in resupply vehicles and mobile artillery pieces. Ammunition conveyance within the magazine is effected smoothly and efficiently during loading and unloading operations by virtue of the resilient suspension and rolling action afforded by the ball casters. The unique cradling action of the ammunition retainers ensures that the projectile and propellant canisters are safely held in their carrier positions throughout the serpentine path of the ammunition conveyor.

In view of the foregoing, it is seen that the objects set forth above, including those made apparent from the preceding Detailed Description, are efficiently attained, and, since certain changes may be made in the construction set forth without departing from the scope of the invention, it is intended that matters of detail be taken as illustrative and not in a limiting sense.

Having described the invention, what is claimed as new and desired to secure by Letters Patent is:

1. A magazine conveyor for handling large caliber ammunition, said conveyor comprising, in combination:

A. an upper chain including a series of pivotally interconnected first links, said upper chain being arranged in a serpentine conveyor path;

B. a lower chain vertically aligned and coextensive with said upper chain and including alternating load-bearing links and connector links in pivotally interconnected relation, said load-bearing links having a pair of platforms arranged in conjoined, side-by-side relation, each said platform serving as a rest for an ammunition round in an upright orientation;

C. a series of rungs interconnecting said upper and lower chains at regularly spaced intervals, the space between each adjacent pair of said rungs defining an ammunition round carrier position;

D. at least two retainers affixed to each said rung in vertically spaced relation, each said retainer including first and second cradle elements, said first cradle elements facing the carrier position to one side of each said rung and configured to conform to the periphery of an ammunition round therein over a first cradling angle, and said second cradle elements facing the carrier position to the other side of each said rung and configured to conform to the periphery of an ammunition round thereat over a second cradling angle, whereby said first and second cradle elements of said retainers affixed to adjacent said rungs are in substantially opposed relation to jointly engage an ammunition round and maintain the upright orientation thereof; and E. upper and lower guide tracks for respectively guiding said upper and lower chains during movement through the conveyor serpentine path.

2. The magazine conveyor defined in claim 1, wherein said first cradling angle is at least 180°.

3. The magazine conveyor defined in claim 2, wherein said second cradling angle is less than 90°.

4. The magazine conveyor defined in claim 1, wherein said lower chain includes a series of ball casters distributed along the length thereof, said ball casters riding over a bottom surface of said lower guide track to provide rolling support for the conveyor.

5. The magazine conveyor defined in claim 1, wherein the ammunition rounds are in the form of projectiles and propellant canisters occupying alternating carrier positions on the conveyor.

6. The magazine conveyor defined in claim 5, wherein said first cradling angle is in excess of 180°, whereby at least the projectiles are cradled by said first cradle elements in snap-fit fashion.

7. The magazine conveyor defined in claim 6, wherein said first cradle elements are lined with an elastomeric material to enhance the physical restraint on the projectiles imposed by said first cradle elements.

8. The magazine conveyor defined in claim 7, wherein, of those said first cradle elements cradling each projectile, at least one is vertically positioned to cradle a rotating band of the projectile.

9. A magazine conveyor for handling large caliber ammunition, said conveyor comprising, in combination:

A. an upper chain including a series of pivotally interconnected first links, said upper chain being arranged in a serpentine conveyor path;

B. a lower chain vertically aligned and coextensive with said upper chain and including alternating load-bearing links and connector links in pivotally interconnected relation, said load-bearing links having a pair of platforms arranged in conjoined, side-by-side relation, each said platform serving as a rest for an ammunition round in an upright orientation;

C. a series of rungs interconnecting said upper and lower chains at regularly spaced intervals, the space between each adjacent pair of said rungs defining an ammunition round carrier position;

D. at least two retainers affixed to each said rung in vertically spaced relation for cradling the ammunition rounds in said carrier positions;

E. upper and lower guide tracks for respectively guiding said upper and lower chains during movement through the conveyor serpentine path; and F. a series of ball casters distributed along the length of said lower chain, said ball casters riding on a bottom surface of said lower guide tracks to provide rolling support for the conveyor.

10. The magazine conveyor defined in claim 9, wherein said ball casters are backed by resilient members to provide cushioned support for the conveyor.

11. The magazine conveyor defined in claim 9, wherein each said retainer including first and second cradle elements, said first cradle elements facing the carrier position to one side of each said rung and configured to conform to the periphery of an ammunition round therein over a first cradling angle, and said second cradle elements facing the carrier position to the other side of each said rung and configured to conform to the periphery of an ammunition round thereat over a second cradling angle, whereby said first and second cradle elements of said retainers affixed to adjacent said rungs are in substantially opposed relation to jointly engage an ammunition round and maintain the upright orientation thereof.

12. The magazine conveyor defined in claim 11, wherein said first cradling angle is at least 180°.

13. The magazine conveyor defined in claim 12, wherein said second cradling angle is less than 90°.

14. The magazine conveyor defined in claim 13, which further includes an additional series of ball casters distributed along the length of said upper chain and riding on a bottom surface of said upper guide tracks.

15. The magazine conveyor defined in claim 14, wherein said ball casters are backed by resilient members to provide cushioned support for the conveyor.

16. The magazine conveyor defined in claim 13, wherein said first cradling angle is in excess of 180°, whereby the ammunition rounds are cradled by said first cradle elements in snap-fit fashion.

17. The magazine conveyor defined in claim 14, wherein said rungs are affixed at upper ends to said first links of said upper chain and affixed at lower ends to said load-bearing and connector links of said lower chain at respective link locations laterally offset from said ball casters, whereby said first and second cradle elements of said retainers affixed to adjacent said rungs assume partially lapped relations while cradling an ammunition round moving through 180° turnarounds of one direction in the serpentine conveyor path, and said first and second cradle elements of retainers affixed to adjacent said rungs assume fully lapped relations while cradling an ammunition round moving through 180° turnaround in the conveyor serpentine path of a direction opposite said one direction.

18. The magazine conveyor defined in claim 17, wherein the ammunition rounds are in the form of projectiles and propellant canisters occupying alternating carrier positions on the conveyor.

19. The magazine conveyor defined in claim 18. Wherein said first cradle elements are lined with an elastomeric material to enhance the physical restraint on the projectile imposed by said first cradle elements.

20. The magazine conveyor defined in claim 19, wherein, of those said first cradle elements cradling each projectile, at least one is vertically positioned to cradle a rotating band of the projectile.

21. The ammunition conveyor defined in claim 14, wherein each said ball caster includes a mounting sleeve having a closed end and an open end, a block of resilient material positioned in said sleeve against said closed end, a ball caster unit positioned in said sleeve against said resilient material block and having a rolling ball protruding beyond said sleeve open end, and a buffer ring affixed to said sleeve about said open end.

* * * * *